US008696410B2

(12) United States Patent
Schüssler et al.

(10) Patent No.: US 8,696,410 B2
(45) Date of Patent: Apr. 15, 2014

(54) DEVICE FOR FINISH-MACHINING OF OPTICALLY EFFECTIVE SURFACES OF, IN PARTICULAR, SPECTACLE LENSES

(75) Inventors: Bernd Schüssler, Pforzheim (DE); Udo Fiedler, Lahnau/Dorlar (DE); Holger Schäfer, Weilmünsten (DE); Steffen Wallendorf, Wetzlar-Dutenhofen (DE)

(73) Assignee: Satisloh AG, Baar (CH)

( * ) Notice: Subject to any disclaimer, the term of this patent is extended or adjusted under 35 U.S.C. 154(b) by 768 days.

(21) Appl. No.: 12/881,738

(22) Filed: Sep. 14, 2010

(65) Prior Publication Data

US 2011/0065361 A1 Mar. 17, 2011

(30) Foreign Application Priority Data

Sep. 16, 2009 (DE) ..... 10 2009 041 442

(51) Int. Cl.
*B24B 7/00* (2006.01)
*B24B 29/00* (2006.01)

(52) U.S. Cl.
USPC ..... 451/160; 451/173; 451/285; 451/289; 451/290; 310/80

(58) Field of Classification Search
USPC ..... 451/11, 158, 160, 173, 259, 277, 283, 451/285, 289, 290; 310/80, 191
See application file for complete search history.

(56) References Cited

U.S. PATENT DOCUMENTS

| | | | | |
|---|---|---|---|---|
| 4,214,180 | A * | 7/1980 | Kuwako et al. | 310/80 |
| 4,245,870 | A * | 1/1981 | Punshon et al. | 384/247 |
| 4,925,348 | A * | 5/1990 | Krusi | 409/231 |
| 7,059,447 | B1 * | 6/2006 | Andonian et al. | 180/444 |
| 7,066,794 | B2 | 6/2006 | Granziera et al. | |
| 7,153,184 | B2 | 12/2006 | Kuebler et al. | |
| 7,278,908 | B2 | 10/2007 | Urban et al. | |
| 7,396,275 | B2 | 7/2008 | Drain et al. | |
| 7,591,710 | B2 | 9/2009 | Drain et al. | |
| 8,536,750 | B2 * | 9/2013 | Ai et al. | 310/191 |
| 2008/0060273 | A1 * | 3/2008 | Bochen et al. | 49/340 |
| 2008/0305723 | A1 | 12/2008 | Philipps et al. | |

FOREIGN PATENT DOCUMENTS

JP 2006088250 A 4/2006

* cited by examiner

*Primary Examiner* — Eileen P. Morgan
(74) *Attorney, Agent, or Firm* — Reising Ethington P.C.

(57) ABSTRACT

A device for finish-machining of the optically effective surfaces of, in particular, spectacle lenses has a spindle shaft, which has a tool mount section and which is mounted in a spindle housing to be rotatable about a workpiece rotational axis (A). An electric rotary drive has a rotor and a stator by which the spindle shaft operatively connected with the rotor is drivable to rotate about the tool rotational axis. An adjusting device axially displaces the tool mount section with respect to the spindle housing in the direction of the tool rotational axis (linear movement Z). The rotor and the stator are arranged coaxially with the spindle shaft, wherein at least the rotor together with the spindle shaft is axially displaceable with respect to the spindle housing in the direction of the tool rotational axis by the adjusting device.

14 Claims, 10 Drawing Sheets

DEVICE FOR FINISH-MACHINING OF OPTICALLY EFFECTIVE SURFACES OF, IN PARTICULAR, SPECTACLE LENSES

FIELD OF INVENTION

The present invention relates in general to a device for finish-machining of optically effective surfaces and has particular reference to a device for finish-machining of the optically effective surfaces of spectacle lenses, such as a device of the kind used in "RX workshops", i.e. fabrication facilities for producing individual spectacle lenses according to prescription within a wide range.

If, in the following, with respect to workpieces with optically effective surfaces there is reference to "spectacle lenses" there is to be understood by that expression not only spectacle, lenses of mineral glass, but also spectacle lenses of all other usual materials, such as polycarbonate, CR 39, HI index, etc., thus also synthetic materials.

DESCRIPTION OF THE PRIOR ART

The machining of optically effective surfaces of spectacle lenses by cutting can be roughly divided into two machining phases, in particular initially pre-machining of the optically effective surface for generation of the macro-geometry in accordance with the prescription and then finish-machining of the optically effective surface in order to eliminate pre-machining tracks and to obtain the desired micro-geometry. Whereas the pre-machining of the optically effective surfaces of spectacle lenses is carried out, inter alia, in dependence on the material of the spectacle lenses by grinding, milling and/or turning, the optically effective surfaces of spectacle lenses during finish-machining are usually subjected to a finish-grinding, lapping and/or polishing process, for which purpose use is made of an appropriate machine.

Polishing machines, which mostly are manually loaded, in RX workshops are usually constructed as 'twin machines' so that the two spectacle lenses of an 'RX job'—a spectacle lens prescription always consists of a pair of spectacle lenses—can be simultaneously finish-machined. Such a 'twin' polishing machine is known from, for example, U.S. Pat. Nos. 7,591,710 B2 and 7,396,275 B2.

In this prior art polishing machine two parallel arranged workpiece spindles, which are each rotationally drivable about a respective axis of rotation, but which are otherwise fixed in position, protrude from below into a working space, where they are disposed opposite two polishing tools so that one polishing tool is associated with one workpiece spindle and the other polishing tool with the other workpiece spindle. Each polishing tool is mounted by way of a spherical bearing to be freely rotatable on a piston rod—which projects from above into the working space—of a respectively associated piston-cylinder arrangement, which is mounted above the working space and by which the respective polishing tool can be individually lowered or raised with respect to the associated workpiece spindle. The two piston-cylinder arrangements are, in addition, movable back and forth in common with respect to a front side of the polishing machine in a direction perpendicular to the axes of rotation of the workpiece spindles by a linear drive and moreover are tiltable in common by a pivot drive about a pivot axis, which similarly extends perpendicularly to the axes of rotation of the workpiece spindles, but parallel to the front side of the polishing machine. By the pivot drive the angular position between the axes of rotation of the tools and workpieces can be preset before the tools are lowered by the piston-cylinder arrangements onto the workpieces. During the actual polishing process the workpieces are rotationally driven, in which case the tools disposed in machining engagement with the workpieces are rotationally entrained by friction, whilst the linear drive ensures that the tools are moved back and forth in alternation with respect to the front side of the polishing machine, as a result of which the tools constantly roam back and forth over the workpieces with a relatively small travel (so called 'tangential kinematics').

Advantages of this 'twin' polishing machine consist, inter alia, in that it is constructed from economic components in a simple manner in terms of engineering, it is very ergonomic for manual loading and moreover due to its extremely compact and very narrow construction requires very little floor space in the RX workshop. However, it would be desirable if other polishing methods could also be performed on such a polishing machine. Thus, for example, the flexible polishing machines disclosed in the specifications U.S. Pat. No. 7,066,794 B2, U.S. Pat. No. 7,278,908 B2 and U.S. Patent Application Publication 2008/0305723 A1 are designed for polishing methods in which, apart from the workpiece, also the tool itself is rotationally driven, whereby polishing times can be significantly shortened by comparison with polishing methods in which the tool is merely entrained by friction.

U.S. Pat. No. 7,255,628 B2 in this connection discloses a polishing device with an electric rotary drive for the polishing tool, which has a stator and a rotor, and a pneumatic piston-cylinder unit for axial deflection of the polishing tool along a longitudinal axis. In this regard, the arrangement of the rotary and axial drives is such that a spindle shaft subassembly ("rotor" in the language of the above-mentioned specification), mounted in a housing to be rotatable about an axis of rotation and carries at its end protruding out of the housing the actual polishing tool, is rotationally driven via a cogged belt drive by the electric rotary drive. The electric rotary drive is arranged in the housing to be laterally offset parallel to the axis of rotation. The pneumatic piston-cylinder unit and an associated axial guide, thereagainst, are integrated in the spindle shaft subassembly and rotationally driven therewith. The piston-cylinder unit thus requires a compressed air rotary feed-through for supply of pressure medium. Apart from the fact that this polishing device is of relatively complicated construction, due to its need for a large constructional volume it is not suitable for use in the afore-described 'twin' polishing machine.

What is needed is a device, which is of as simple and economic construction as possible, for finish-machining of optically effective surfaces of, in particular, spectacle lenses, by which, for example, a polishing tool can be rotationally driven as well as axially displaced and which is nevertheless very compact so that it can be used in, for example, 'twin' polishing machines of very narrow construction such as the polishing machine described in the introduction.

SUMMARY OF THE INVENTION

According to the present invention there is provided a device for finish-machining of the optically effective surfaces of, in particular, spectacle lenses, which device comprises a spindle shaft, which has a tool mount section and which is mounted in a spindle housing to be rotatable about a tool rotational axis, an electric rotary drive, which comprises a rotor and a stator and by which the spindle shaft operatively connected with the rotor is drivable to rotate about the tool rotational axis, and an adjusting device, by which the tool mount section is axially displaceable with respect to the spindle housing in the direction of the tool rotational axis, wherein the rotor and the stator of the electric rotary drive as well as the spindle shaft are arranged coaxially and wherein at least the rotor of the electric rotary drive together with the spindle shaft is axially displaceable with respect to the spindle housing in the direction of the tool rotational axis by the adjusting device.

Due to the fact that the rotor and the stator of the electric rotary drive are arranged together with the spindle shaft on one and the same axis, the device is advantageously of compact construction. Moreover, the spindle shaft can be directly rotationally driven without the need for transmission elements, such as gearwheels, cogged belts or the like, which are susceptible to play or slip. This reduces the overall technical outlay on the device, appreciably diminishes the need for constructional volume for this drive and moreover avoids losses in efficiency as well as wear attributable to a transmission.

In addition, the relative arrangement of axial adjusting device and electric rotary drive is such that together with the rotationally driven spindle shaft at least the rotor of the electric rotary drive is axially displaceable relative to the spindle housing in the direction of the axis of rotation. In other words, as seen in the effective direction of the tool the axial adjusting device is positioned in front of the electric rotary drive so that (at least) the rotationally moved components are axially displaceable as a whole by the adjusting device, whereby the adjusting device can be mounted at or in the spindle housing to be secure against rotation relative thereto and complicated rotary feed-throughs or the like are superfluous.

As a result, the device is particularly suitable for use in, for example, the 'twin' polishing machine described in the introduction, so that in the case of use of other polishing methods with rotationally driven polishing tools the machining times can be significantly shortened (i.e. approximately by the divisor 3) without the complexity of the machine being excessively increased or the need for constructional volume or floor space being in any way increased.

In the case of a suitable length of stator or rotor of the electric rotary drive it is fundamentally possible for the arrangement to be such that merely the rotor of the electric setting drive is axially displaced by the adjusting device and the stator is axially fixed. However, it is preferred, particularly with respect to a small constructional volume, low costs and a constant transmission of force from the stator to the rotor for predetermined rotational speeds, if the rotor and the stator of the electric rotary drive are mounted in a common motor housing to be non-displaceable relative to one another in the direction of the tool rotational axis, wherein the axial adjusting device is operatively connected with the motor housing and thus the motor housing is displaceable together with the spindle shaft with respect to the spindle housing in the direction of the tool rotational axis.

The axial adjusting device can be, in principle, an electrical or electromechanical, hydraulic or hydropneumatic linear actuator. However, with respect to a construction which is as simple and economic as possible it is preferred if the adjusting device is a double-acting pneumatic piston-cylinder arrangement comprising a piston rod by way of which the axial displacing movement is transmissible to the electric rotary drive and which is axially aligned with the spindle shaft. The latter feature is not only beneficial with regard to a compact construction of the overall device, but beyond that also prevents tipping moments from being transferred from the axial adjusting device to the spindle shaft, which could obstruct an easy motion in the axial displacement of the spindle shaft with respect to the spindle housing.

In this connection it is to be noted that, for example, for use of the device according to the invention in a polishing machine for spectacle lenses the axial movement of the spindle shaft should preferably be very light so that even with low adjusting forces or polishing pressures a low-friction adjustment of the polishing tool held at the tool mount section of the spindle shaft is possible. This characteristic is particularly important for the polishing of spectacle lenses with toroidal, aspherical or varifocal surfaces having a high degree of deviation from rotational symmetry, so that the polishing tool always bears against the spectacle lens snugly or over an area and with a polishing force (or pressing force) which is settable with fine sensitivity. If the polishing tool during its high-speed rotational movement were to lose area contact with the workpiece surface even only temporarily, scratching of the polished spectacle lens surface could arise due to the coarser grains and agglomerates present in the polishing medium.

In order to also counteract, in simple manner, transfer to the spindle shaft of possible stick-slip effects between piston and cylinder of the pneumatically loadable piston-cylinder arrangement and possible negative consequences for the axial adjusting movement of the spindle shaft, the piston rod of the axial adjusting device is preferably operatively connected with the electric rotary drive by way of a diaphragm cylinder, which has a diaphragm, for transfer of the axial displacing movement. Such a diaphragm cylinder itself operates free of stick-slip and in addition permits small axial stroke movements at the electric rotary drive and thus the spindle shaft without the piston rod of the adjusting device having to execute an axial stroke for that purpose.

In an advantageous embodiment the diaphragm can be of annular construction, wherein the diaphragm is mounted at the inner circumferential side at the piston rod of the adjusting device and clamped at the outer circumferential side at the electric rotary drive, so that the force flow of an axial force applied to the piston rod runs from the piston rod to the electric rotary drive via a diaphragm. However, instead of that it is also possible—if less preferred—to mount the annular diaphragm at the inner circumferential side at the electric rotary drive and to hold it at the outer circumferential side at a suitably designed piston rod.

In principle, the diaphragm can be made of, for example, a spring steel. In a preferred embodiment, however, the diaphragm consists of an elastomeric material. This has the advantage that the diaphragm due to its elasticity is also capable of providing compensation in radial direction, i.e. perpendicularly to the tool rotational axis, so that the diaphragm can equally provide compensation in simple and effective manner for alignment errors and Cardanic errors between piston rod and spindle shaft, which could lead to jamming of the spindle shaft.

In a further advantageous embodiment of the device the piston rod of the axial adjusting device can be provided with a passage bore which pneumatically connects a pressure chamber, which is remote from the tool mount section, of the adjusting device with a pressure chamber, which faces the tool mount section, of the diaphragm cylinder, wherein the mutually facing pneumatically effective surfaces in the stated pressure chambers are of substantially the same size. Due to the fact that these pressure chambers can communicate with one another by way of the passage bore in the piston rod and in that case pneumatically effective surfaces of approximately the same size are juxtaposed, the forces acting on the diaphragm, i.e. the setting force produced by the adjusting device and transmitted by way of the piston rod and the opposing force of the same size pneumatically generated at the diaphragm, cancel one another when the said pressure chamber of the axial adjusting device is pneumatically loaded, so that the diaphragm is not excessively deformed or changed in shape, which is also beneficial for a long service life of the diaphragm.

It is further preferred if the spindle shaft is rotatably mounted at the inner circumference of a spindle sleeve, which in turn is axially guided at its outer circumference with respect to the spindle housing, so that advantageously the rotational journaling and the axial guidance are functionally separated even within a confined space. In this connection, use can be made for axial guidance of the spindle sleeve of, for example, slide bushes or air-bearing bushes. However, the spindle sleeve is preferably axially guided in the spindle housing by guides in the form of ball bushings, i.e. bushings with linear tracks of caged balls, which is advantageous with respect to easy motion, long life and costs.

The spindle sleeve can, in principle, be constructed integrally with the motor housing. However, it is advantageous with respect to simple production and assembly if the spindle sleeve is flange-mounted on the motor housing of the electric rotary drive.

In a preferred embodiment the spindle housing can comprise a housing lower part near the tool mount section of the spindle shaft and a housing upper part remote from the tool mount section of the spindle shaft, the housing parts having different internal diameters, wherein the spindle sleeve is axially guided in the smaller-diameter housing lower part, whilst the motor housing of the electric rotary drive is axially displaceable in the larger-diameter housing upper part in the manner of a piston, but with radial play with respect to the spindle housing. This embodiment has on the one hand the advantage that the axial guidance is provided near the tool so that, for example, bending oscillations of the spindle shaft induced by machining are largely avoided and on the other hand the advantage that an air movement or an air exchange, which contributes to cooling of the electric rotary drive, is constrained at the motor housing of the electric rotary drive via the radial gap with respect to the spindle housing when axial movement of the motor housing occurs. In this connection, housing upper part and housing lower part of the spindle housing can be of single-part or two-part construction. The latter is advantageous to the extent that production is simpler and different materials can be used for the housing parts, for example an aluminum alloy for the housing upper part in order to optimize weight (i.e. smallest possible moved mass) and, for example, stainless steel for the lower part, in order to impart strength and corrosion resistance to the latter.

In order to provide rotational fixing of the motor housing of the electric rotary drive relative to the spindle housing in a manner which is as low in friction and favorable in costs as possible, the motor housing can be secured against rotation relative to the spindle housing by a torque support, one end of which is fastened to the motor housing and its other end carries a rotatably mounted guide roller bearing against a guide surface at the spindle housing side. In this regard it is preferred if the torque support and the spindle sleeve axially guided in the spindle housing are arranged on axially opposite sides with respect to the motor housing, which is again required, in particular, for a compact and slender form of construction of the device, even if in principle it is also conceivable to provide a torque support for the spindle housing near or even at the spindle sleeve.

Finally, it is particularly advantageous to use the aforedescribed device in double format in a polishing machine for simultaneous polishing of two spectacle lenses, which polishing machine comprises (i) a machine housing bounding a working space, (ii) two workpiece spindles which protrude into the working space and by way of which two spectacle lenses are drivable by a common rotary drive to rotate about mutually parallel workpiece axes of rotation, (iii) a linear drive unit by which a tool carriage is movable along a linear axis extending substantially perpendicularly to the workpiece axes of rotation and (iv) a pivot drive unit which is arranged on the tool carriage and by which a pivot yoke is pivotable about a pivot set axis extending substantially perpendicularly to the workpiece axes of rotation and substantially perpendicularly to the linear axis, and, in particular, in such a manner that the two devices protrude by their tool mount sections respectively associated with the workpiece spindles into the working space and are flange-mounted by the spindle housings thereof on the pivot yoke, so that the tool rotational axis of each device forms with the workpiece rotational axis of the associated workpiece spindle a plane in which the respective tool rotational axis is axially displaceable and tiltable with respect to the workpiece rotational axis of the associated workpiece spindle. A 'twin' polishing machine constructed and equipped in that manner is distinguished not only by the fact that it is of very compact construction—to that extent also easy to manually load—and in very economic manner utilizes numerous common drives, but particularly also by the fact that the movement possibilities provided by the device according to the invention, namely the active rotational movement possibility of the polishing tools mounted thereon, enable, by comparison with the prior art outlined in the introduction, performance of other polishing methods which faster or more efficient in terms of time.

BRIEF DESCRIPTION OF THE DRAWINGS

A preferred embodiment of the present invention will now be more particularly described by way of example with reference to the accompanying drawings, which are partly simplified or schematic and in which.

DETAILED DESCRIPTION OF THE PREFERRED EMBODIMENT

Figure 1:
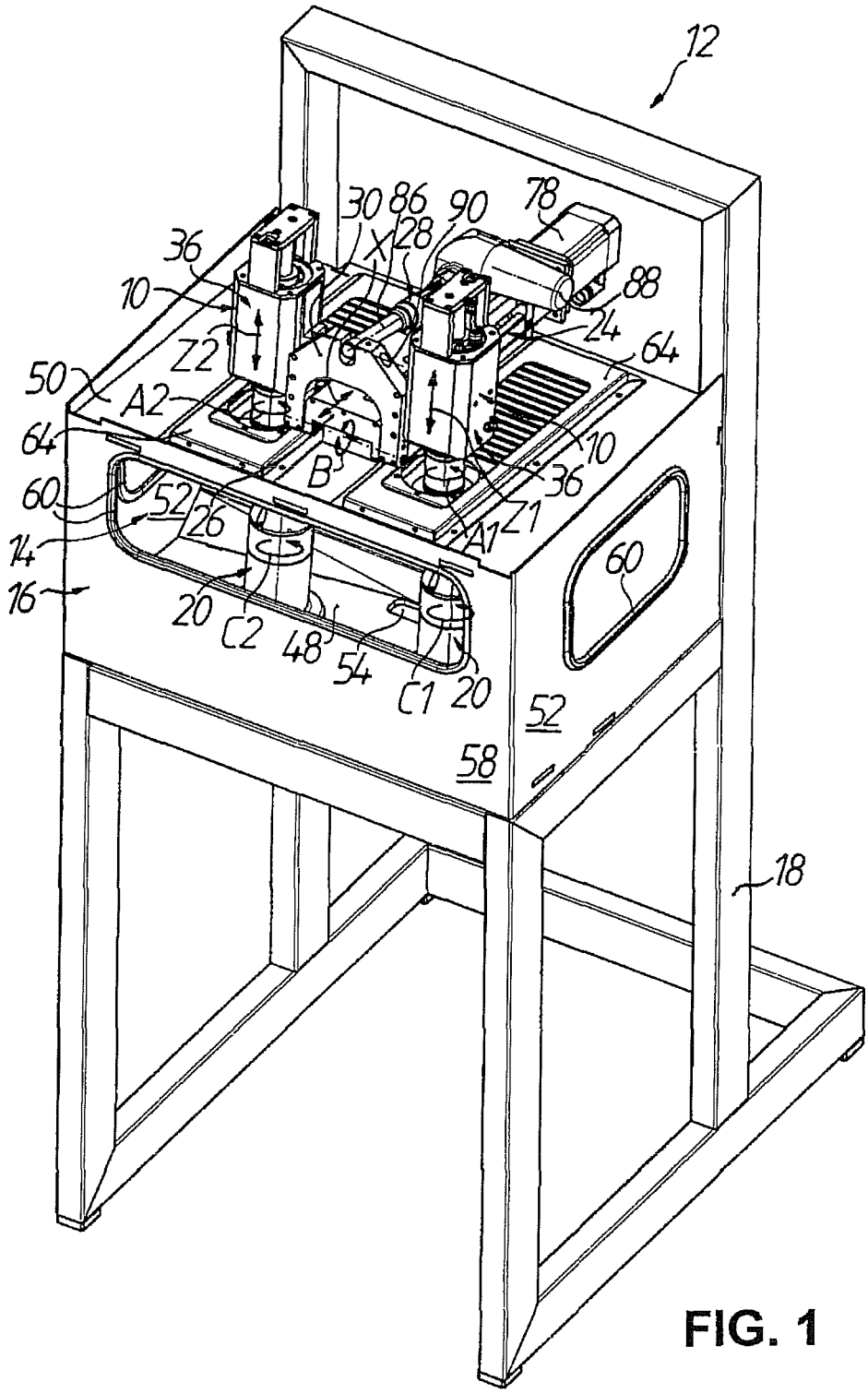
FIG. 1 is a perspective view of a polishing machine for spectacle lenses obliquely from above and the front right with two parallel arranged devices embodying the invention for finish-machining of the optically effective surfaces of the spectacle lenses, wherein in order to provide a view of significant components or subassemblies of the machine and in order to simplify the illustration an operating unit and control, parts of the cladding, door mechanisms and panes, receptacles for workpieces and tools, supply devices (including lines, hoses and pipes) for power, compressed air and polishing medium, a polishing medium return and measuring, servicing and safety devices have been omitted.

In FIGS. 1 to 5 there is shown a polishing machine 12 having a 'twin' mode of construction for simultaneous action on two workpieces, and illustrating the preferred location for two devices 10 are for finish-machining of the optically effective surfaces of workpieces such as, for example, spectacle lenses L. The polishing machine 12 has (i) a machine housing 16, which bounds a working space 14 and which is mounted on a machine frame 18, (ii) two workpiece spindles 20, which protrude into the working space 14 and by way of which two spectacle lenses L to be polished can be driven by a common rotary drive 22 (see FIGS. 3 to 5) to rotate about mutually parallel extending workpiece rotational axes C1, C2 (C in FIG. 11), (iii) a linear drive unit 24, by which a tool carriage 26 can be moved along a linear axis X extending substantially perpendicularly to the workpiece rotational axes C1, C2, (iv) a pivot drive unit 28, which is arranged on the tool carriage 26 and by which a pivot yoke 30 mounted on the carriage can be pivoted about a pivot setting axis B extending substantially perpendicularly to the workpiece rotational axes C1, C2 and substantially perpendicularly to the linear axis X, and finally (v) two of the above-mentioned devices 10.

Figure 6:
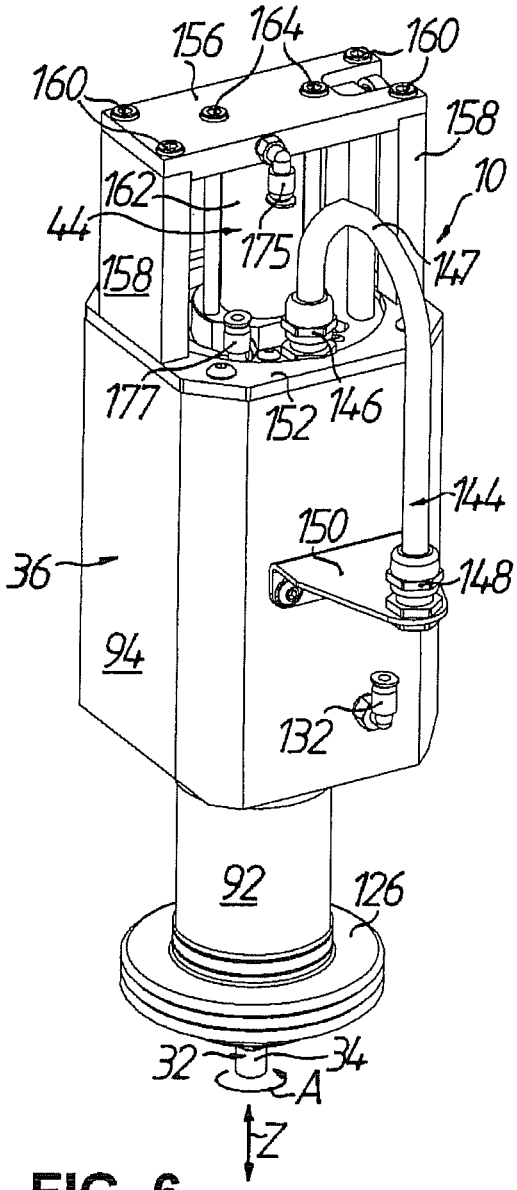
FIG. 6 is a perspective view, which is enlarged in scale by comparison with FIGS. 1 to 5, of one of the devices embodying the invention in the polishing machine of FIG. 1, in which by comparison with FIGS. 1 to 5 a part, which is mounted by a fastening bracket on a housing of the device, of the power feed to an electric rotary drive of the device is illustrated.

As will be explained more specifically in the following with reference to FIGS. 6 to 11, each of the devices 10 has in general (a) a spindle shaft 32, which has a tool mount section 34 and which is mounted in a spindle housing 36 to be rotatable about a tool rotational axis A1, A2 (A in FIG. 6), (b) an electric rotary drive 38, which includes a rotor 40 and a stator 42 and by which the spindle shaft 32 operatively connected with the rotor 40 can be driven to rotate about the tool rotational axis A1 or A2, and (c) an axial adjusting device 44, by which the tool mount section 34 can be axially shifted or displaced with respect to the spindle housing 36 in the direction of the tool rotational axis (linear movement Z1, Z2, or Z in FIG. 6). In this connection, significant features of the device 10 are that the rotor 40 and the stator 42 of the electric rotary drive 38 are arranged coaxially with the spindle shaft 32 and that by the adjusting device 44 at least the rotor 40 of the electric rotary drive 38, in the illustrated embodiment in fact the entire electric rotary drive 38, together with the spindle shaft 32 can be axially displaced with respect to the spindle housing 36 in the direction of the tool rotational axis A1 or A2 (linear movement Z1 or Z2), as will similarly be described in more detail in the following.

Figure 2:
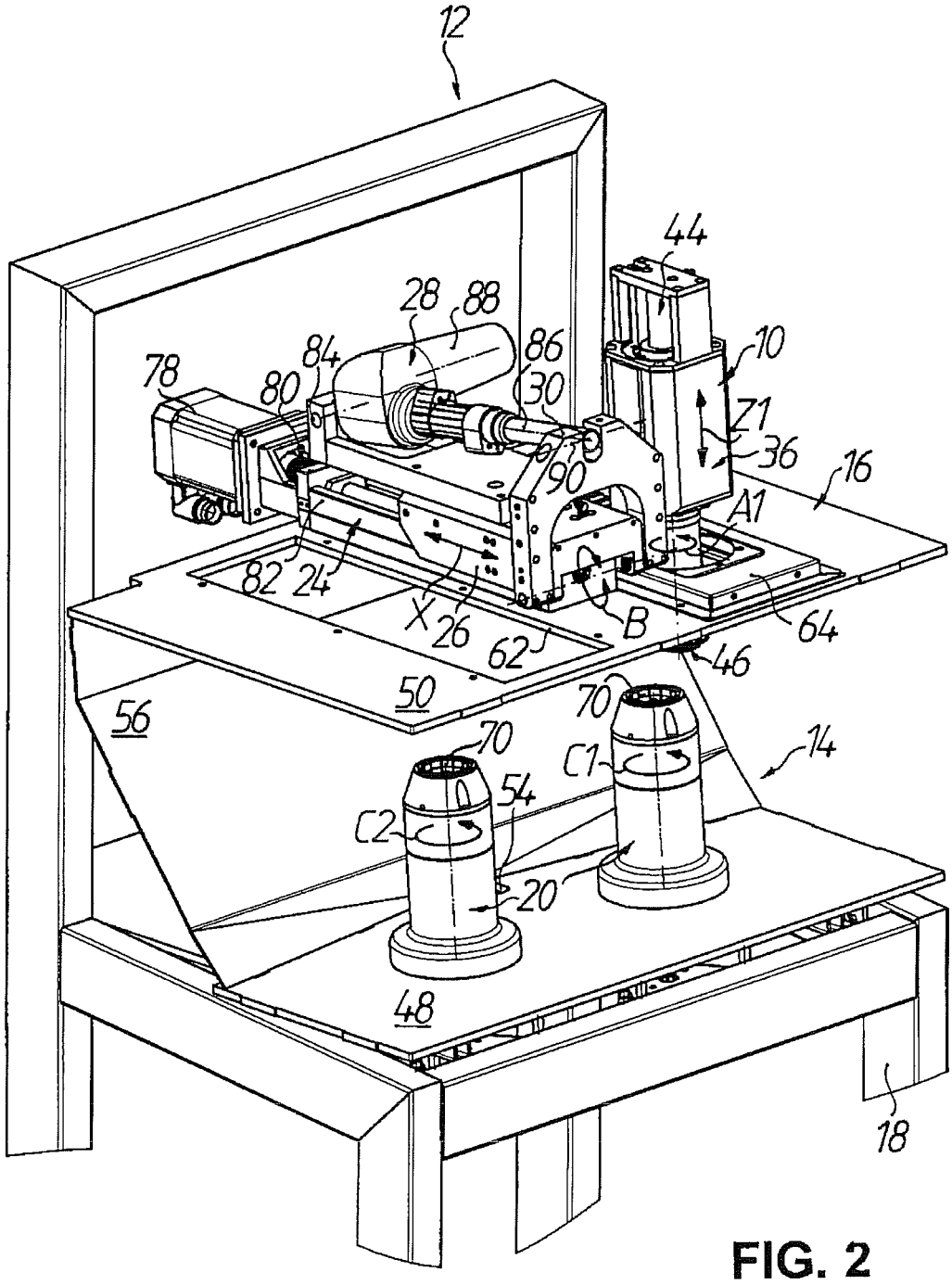
FIG. 2 is a perspective view, which is enlarged in scale by comparison with FIG. 1 and broken away at the machine frame, of the polishing machine of FIG. 1 obliquely from above and the front left, wherein on the one hand the device embodying the invention at the left in FIG. 1 and an associated, flexible working space cover have been omitted so as to illustrate the mounting arrangement for that device and on the other hand the side walls and the front wall of the sheet metal housing bounding the working space have been omitted so as to provide a view of two parallel arranged workpiece spindles, each of which is associated with a respective one of the devices embodying the invention.
Figure 3:
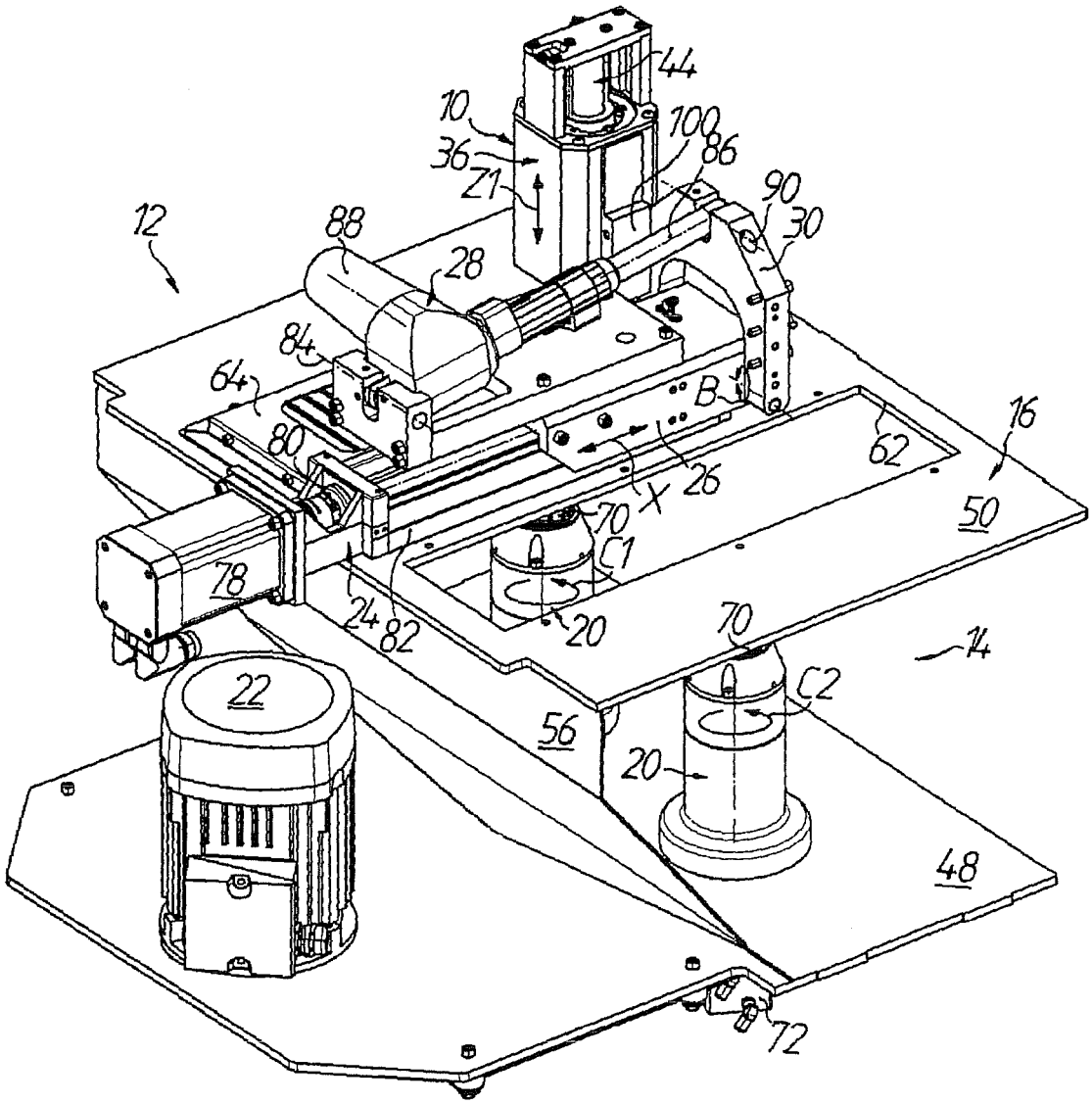
FIG. 3 is a perspective view, which is further enlarged in scale by comparison with FIG. 2, of the polishing machine of FIG. 1 obliquely from above and at the back right, wherein by comparison with the illustration in FIG. 2 the machine frame has also been omitted.
Figure 4:
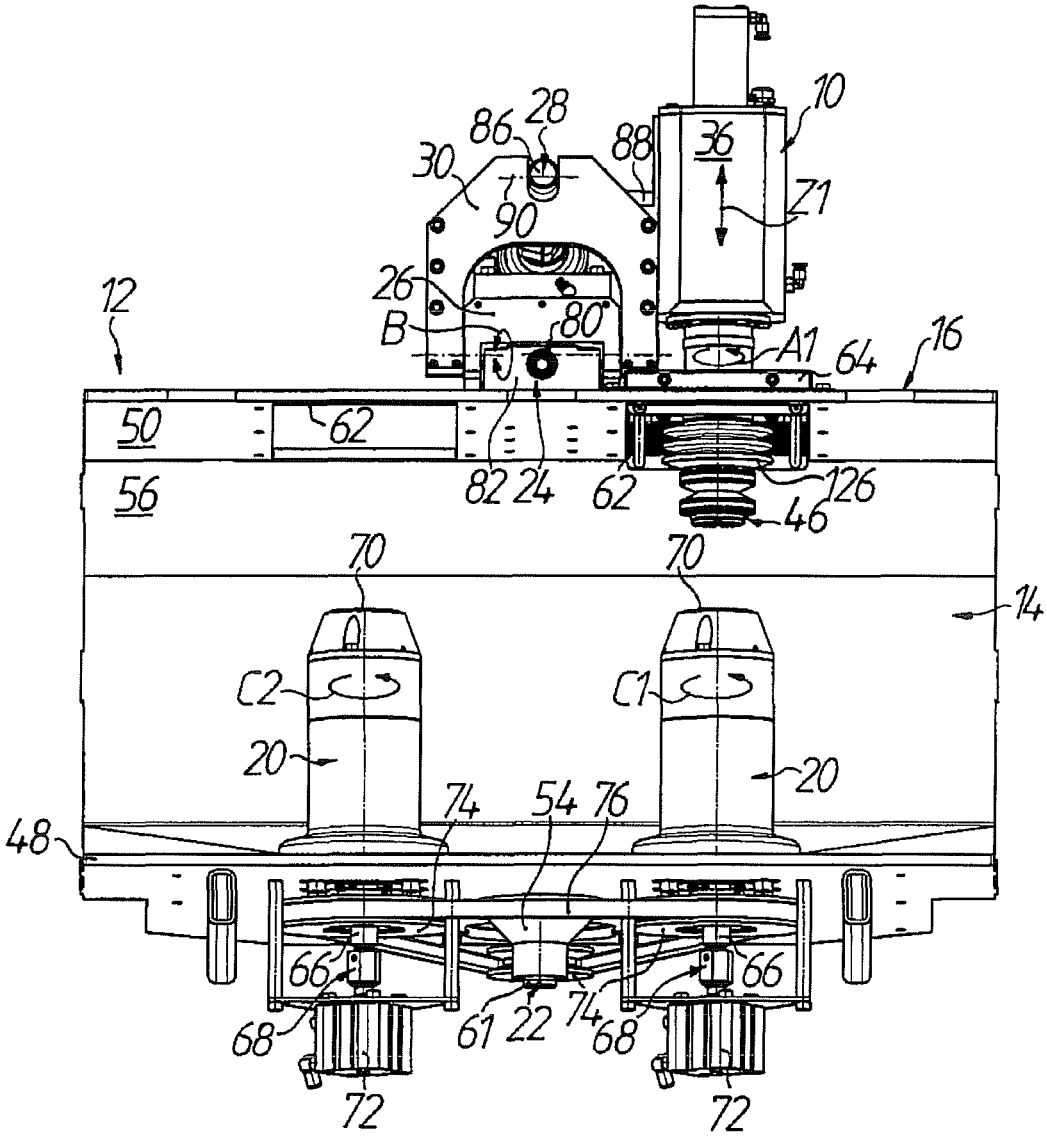
FIG. 4 is a front view of the polishing machine of FIG. 1 in the scale and with the simplifications of FIG. 3.

As more clearly shown in FIGS. 1, 3 and 4 the devices 10 are flange-mounted by their spindle housings 36 on the pivot yoke 30 of the polishing machine 12 in such a manner that they project by their tool mount sections 34, which are each associated with a respective one of the workpiece spindles 20, into the working space 14. The tool rotational axis A1 or A2 of each device 10 forms with the workpiece rotational axis C1 or C2, respectively, of the associated workpiece spindle 20 a notional plane (perpendicular to the drawing plane of FIG. 4 and parallel to the drawing plane of FIG. 5) in which the respective tool rotational axis is axially displaceable (linear axis X, linear movement Z) and tiltable (pivot axis B) with respect to the workpiece rotational axis of the associated workpiece spindle 20. The tool mount sections 34 of the spindle shafts 32 cannot, however, be seen in FIGS. 1 to 5, because a polishing tool 46 (here shown without polishing cap) is mounted on the respective tool mount section 34, as is also illustrated in section in FIG. 11.

The machine housing 16 mounted at an inclination on the machine frame 18 in accordance with, in particular, FIG. 2 is constructed as a welded sheet metal housing with a base plate 48, a top plate 50, two side walls 52, a back wall 56 inclined towards an outlet 54 provided in the base plate 48, and a front wall 58, which together bound the working space 14. The side walls 52 and the front wall 58 are provided with windows 60. Round cut-outs (not shown in more detail) for the passage of the workpiece spindles 20 and a drive shaft 61 of the rotary drive 22 are provided in the base plate 48 and elongate cut-outs 62 (see FIGS. 2 to 4) for passage of the devices 10 are provided in the top plate 50. The elongate cut-outs 62 also enable axial forward and backward movement of the devices 10 in the direction of the linear axis, i.e. in the direction of the front wall 58 and away therefrom, wherein in the illustrated embodiment a respective bellows cover 64, forming a flexible working space cover, is provided for sealing relative to the working space 14.

Figure 5:
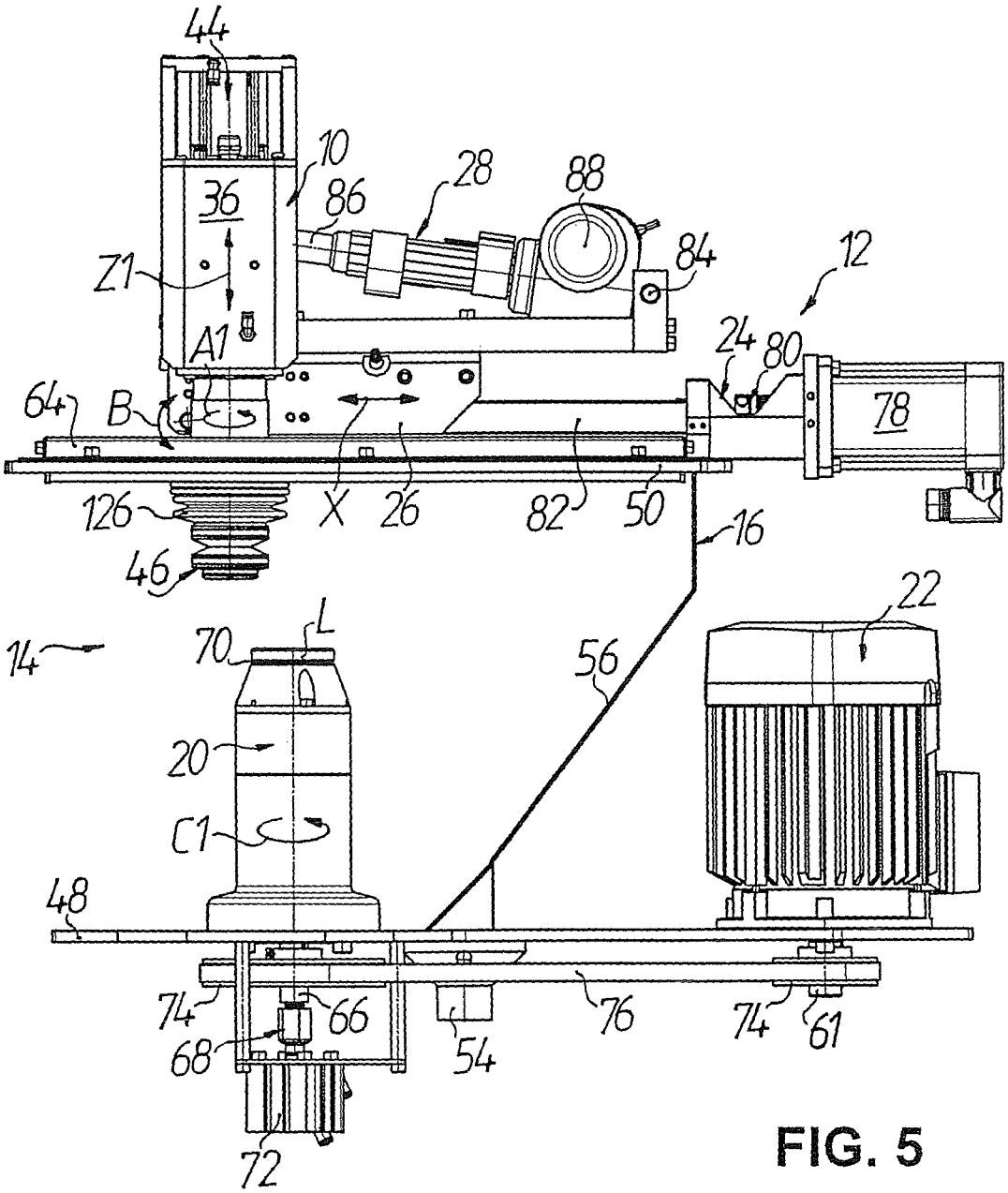
FIG. 5 is a side view of the polishing machine of FIG. 1 from the right in FIG. 4, again in the scale and with the simplifications of FIG. 3.
Figure 11:
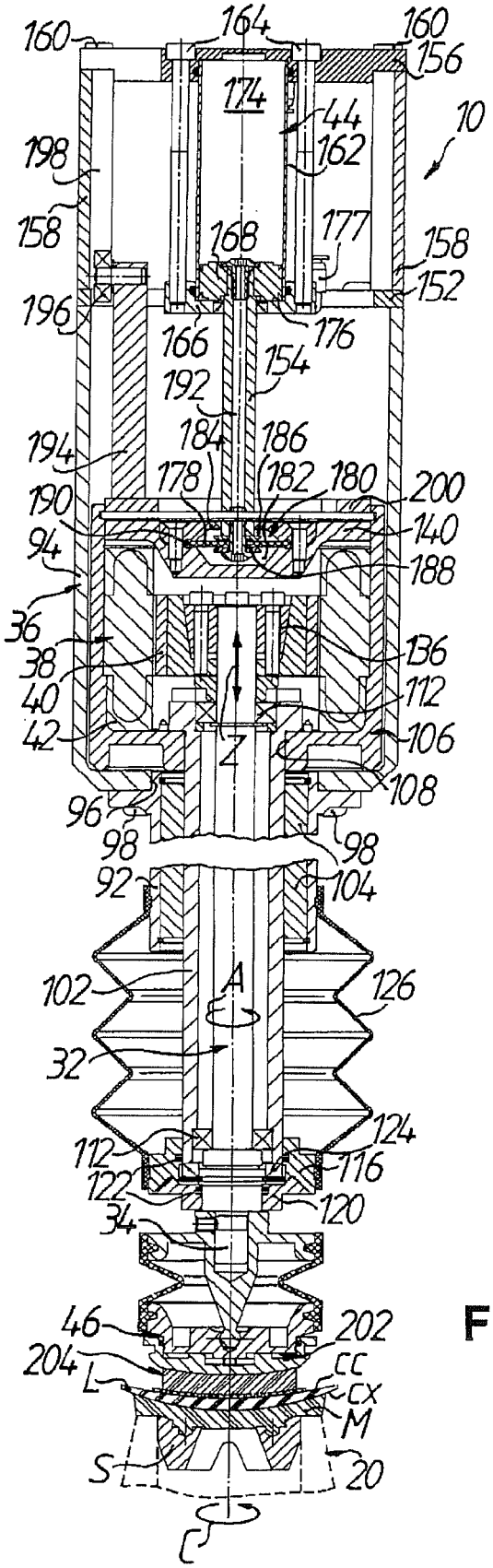
FIG. 11 is a partly broken-away sectional view of the device of FIG. 6 in correspondence with the sectional view in FIG. 10, wherein, however, the device is illustrated in a state in which a polishing tool mounted on the device is disposed in machining engagement with a spectacle lens, which lens is mounted by a block member on a workpiece spindle indicated by a dashed line.

As can be readily seen in, in particular, FIGS. 4 and 5, the workpiece spindles 20 in the working space 14 are flange-mounted from above on the base plate 48 and pass through this in each instance by a drive shaft 66 and an actuating mechanism 68 for a chuck 70, by which a spectacle lens L mounted on a block member S can be clamped to the respective workpiece spindle 20 in axially fixed position and with a capability of rotational entrainment (cf. FIG. 11). Pneumatic cylinders of the actuating mechanisms 68, by which the chucks 70 can be opened and closed in a manner known per se, are fastened below the base plate 48 and denoted by 72. The rotary drive 22—in the illustrated embodiment a speed-controlled synchronous three-phase alternating current motor—is similarly flange-mounted from above on the base plate 48 behind the rear wall 56, i.e. outside the working space 14. Further, below the base plate 48 belt pulleys 74 are fastened to the drive shafts 61, 66 of rotary drive 22 and workpiece spindles 20 and are operatively connected by a V-belt 76 so that the rotary drive 22 is capable of rotationally driving the two workpiece spindles 20 at the same time at a predetermined rotational speed (workpiece rotational axes C1, C2 or C).

As can be best seen in FIGS. 2 to 4, the linear drive unit 24 in the illustrated embodiment has a ball screw 80, which is driven by a servomotor 78 by way of a clutch and which is received in a guide box 82, which is fastened from above on the top plate 50 and on which the tool carriage 26 is guided. This substantially horizontally extending linear axis X is subject to CNC positional regulation (closed loop control); however, for simplification of the illustration the associated travel measuring system is not shown.

According to FIGS. 1 to 4 the substantially U-shaped pivot yoke 30 is articulated by its limbs to the end, which is at the front in FIGS. 1 and 2, of the tool carriage 26 so that it can pivot about the pivot axis B. The pivot drive unit 28 is articulated to the end, which is at the back in FIG. 2 and at the right in FIG. 5, of the tool carriage 26 so that it can pivot about an axis 84. The pivot drive unit 28 is, in the illustrated embodiment, a proprietary linear module such as is available, for example, under the designation "stroke cylinder CARE 33" from the company SKF. This linear module, which is used in large numbers as, for example, an automatic window opener or for adjustment of hospital beds, has a stroke rod 86 able to be moved in or out by way of a spindle drive (not shown in more detail) powered by a direct current motor 88. In this connection, the self-locking capability of the spindle drive provides that the stroke rod 86 remains in the position into which it has been moved—even under greater axial loads—when the direct current motor 88 is switched off, without a brake or the like being needed for that purpose. The stroke rod 86 of the pivot drive unit 28 is articulated by its end, which is remote from the direct current motor 88, in a middle region—which is at the top in FIGS. 1 to 4—of the U-shaped pivot yoke 30, so that the stroke rod 86 can pivot relative to the pivot yoke 30 about a further axis 90. To that extent it is apparent that in the chain of articulation described above a defined axial movement in or out of the stroke rod 86 has the result that the pivot yoke 30 is pivoted in a defined manner about the pivot setting axis B.

Finally, with regard to the movement capabilities of the polishing tool 46 held at the device 10, it is to be noted that the electric rotary drive 38 of the device 10—a synchronous three-phase alternating current motor in the illustrated embodiment—is speed-controlled (tool rotational axes A1, A2 or A). The linear movement, which can be produced by the axial adjusting device 44 of the device 10, of the polishing tool 46 in the direction Z1, Z2 or Z, thereagainst, is uncontrolled and unregulated. This movement capability serves the purpose of bringing the polishing tool into contact with the spectacle lens L before the actual polishing process, pressing the polishing tool 46 by a predetermined force in the direction of the lens L during the polishing process in order to generate a polishing pressure and lifting the polishing tool 46 back off the lens L after the polishing process.

Accordingly, the afore-described polishing machine 12 makes possible, for example, the following procedure, which is to be described for only one spectacle lens L in view of the fact that the second spectacle lens L of the respective 'RX job' is subject to polishing processing in analogous manner and at the same time. After equipping the polishing machine 12 with the polishing tools 46 and with the lenses L to be machined, initially the angle of incidence of the tool rotational axes A1, A2 or A with respect to the workpiece rotational axes C1, C2 or C is set in dependence on the geometry, which is to be produced, at the lens L to a predetermined value (pivot setting axis B) by the pivot drive unit 28. This angle of incidence is not changed during the actual polishing. The polishing tool 46 is then moved by the linear drive unit 24 into a position in which it is opposite the lens L (linear axis X). The polishing tool 46 is thereupon axially displaced by the adjusting device 44 of the device 10 in a direction towards the lens L until it comes into contact therewith (linear movement Z1, Z2 or Z). The polishing medium feed is now switched on and the polishing tool 46 as well as the lens L are now set into rotation by the electric rotary drive 38 or the rotary drive 22 (tool rotational axes A1, A2 or A; workpiece rotational axes C1, C2 or C). For preference, the tool and workpiece run synchronously in the same sense; however, it is also possible to drive the tool and workpiece in opposite sense and/or to allow them rotate at different rotational speeds. The polishing tool 46 is now moved in oscillating manner with relatively small strokes over the lens L by the linear drive unit 24 (linear axis X) so that the polishing tool 46 is guided over different area regions of the lens L. The polishing tool 46 also moves slightly back and forth following the (non-round) geometry of the polished lens L (linear movement Z1, Z2 or Z). Finally, the polishing tool is lifted off the lens L by the adjusting device 44 of the device 10 (linear movement Z1, Z2 or Z), after the polishing medium feed was switched off and the rotational movements of tool and workpiece stopped. At the end, the polishing tool 46 is moved by the linear drive unit 24 into a position (linear axis X) which allows removal of the lens L from the polishing machine 12.

The construction and function of the device 10 is described in more detail in the following with reference to FIGS. 6 to 11.

Figure 9:
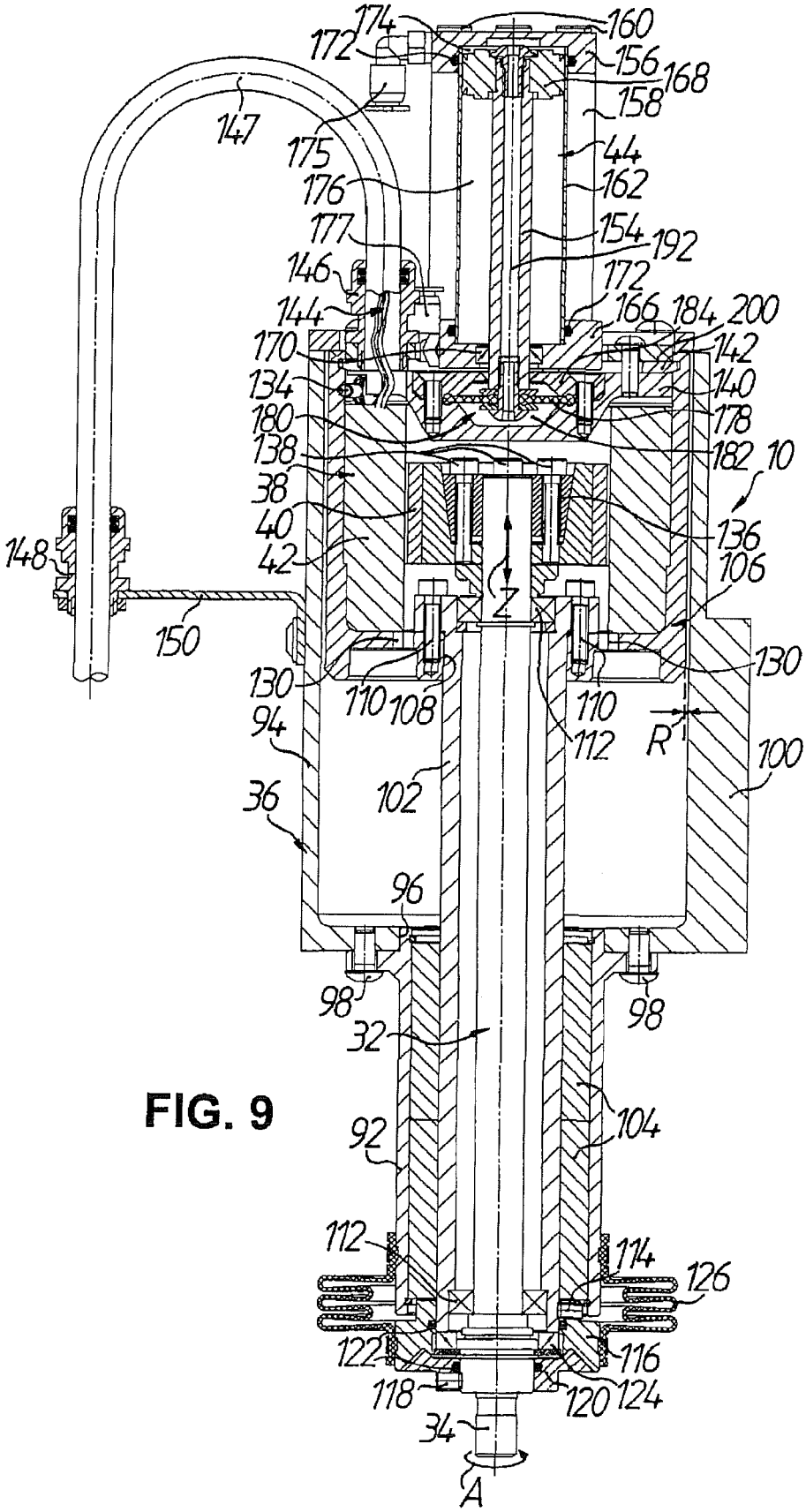
FIG. 9 is a sectional view, which is reduced in scale by comparison with FIG. 8 and which is turned in clockwise sense in the drawing plane through 90°, of the device in FIG. 1 along the section line IX-IX in FIG. 8, the upper cylinder mount now being shown.
Figure 10:
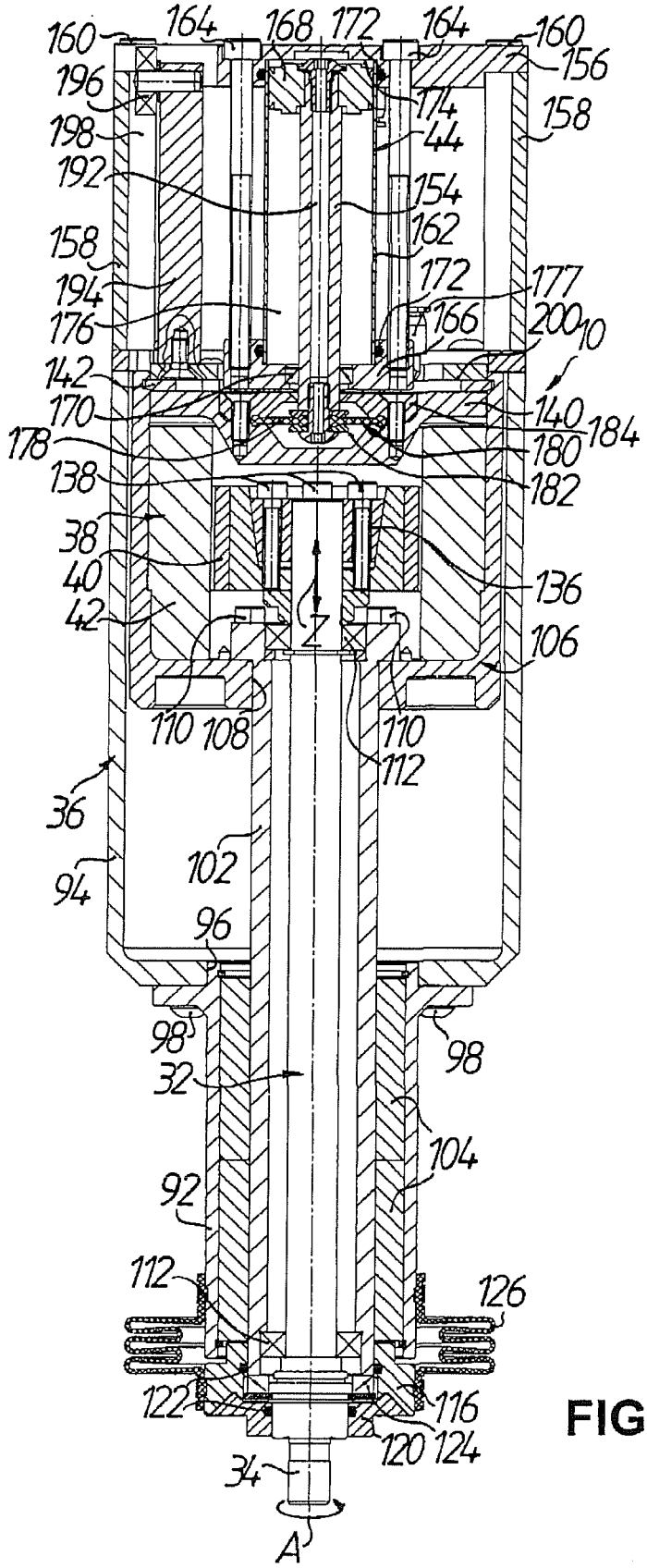
FIG. 10 is a sectional view, which is reduced in scale by comparison with FIG. 8 and which is turned in the drawing plane through 180° and partly broken away, of the device of FIG. 6 along the section line X-X in FIG. 8, again showing the upper cylinder mount.

According to, in particular, to FIGS. 9 and 10 the spindle housing 36 is of two-part construction, with a sleeve-like housing lower part 92 near the tool mount section 34 of the spindle shaft 32 and a substantially beaker-shaped housing upper part 94 remote from the tool mount section 34 of the spindle shaft 32, wherein the housing lower part 92 and the housing upper part 94 are of hollow-cylindrical construction with different internal diameters. The housing lower part 92 is flange-mounted in the region of an opening 96 in the base of the housing upper part 94 on the housing upper part 94 with the assistance of screws 98. A flange section 100 by way of which the device 10 can be flange-mounted on the pivot yoke 30 of the polishing machine 12 on the left-hand or right-hand side can be seen at the housing upper part 94 on the right in FIG. 9 (and at the top in FIG. 8), wherein three cap screws pass through the pivot yoke 30 and are screwed into associated threaded blind bores in the flange section 100, as can be seen in, in particular, FIGS. 3 and 4.

In the smaller-diameter housing lower part 92 a substantially tubular spindle sleeve 102 is axially guided substantially free of radial play at its outer circumference by one or more guides—in the illustrated embodiment in the form of two ball bushings 104—with respect to the spindle housing 36, whereas in the larger-diameter housing upper part 94 a substantially beaker-shaped motor housing 106 of the electric rotary drive 38 is received in the manner of a piston, but with radial play R (see FIG. 9), to be axially displaceable relative to the spindle housing 36. In this connection the housing upper part 94 is dimensioned in length in such a manner that the motor housing 106 can be axially displaced in the spindle housing 36 by a stroke of approximately 60 millimeters. The spindle sleeve 102 is flange-mounted on the motor housing 106 of the electric rotary drive 38 in the region of an opening 108 in the base of the motor housing 106 with the help of screws 110 (see again FIG. 9).

The spindle shaft 32 is rotatably mounted near each of the two ends thereof by a respective bearing 112, for example a ball bearing, at the inner circumference of the spindle sleeve 102. The spindle shaft 32 extends completely through the spindle sleeve 102 and protrudes at the bottom in FIGS. 9 to 11, particularly by its tool mount section 34, beyond the spindle sleeve 102, and upwardly into the motor housing 106.

Figure 7:
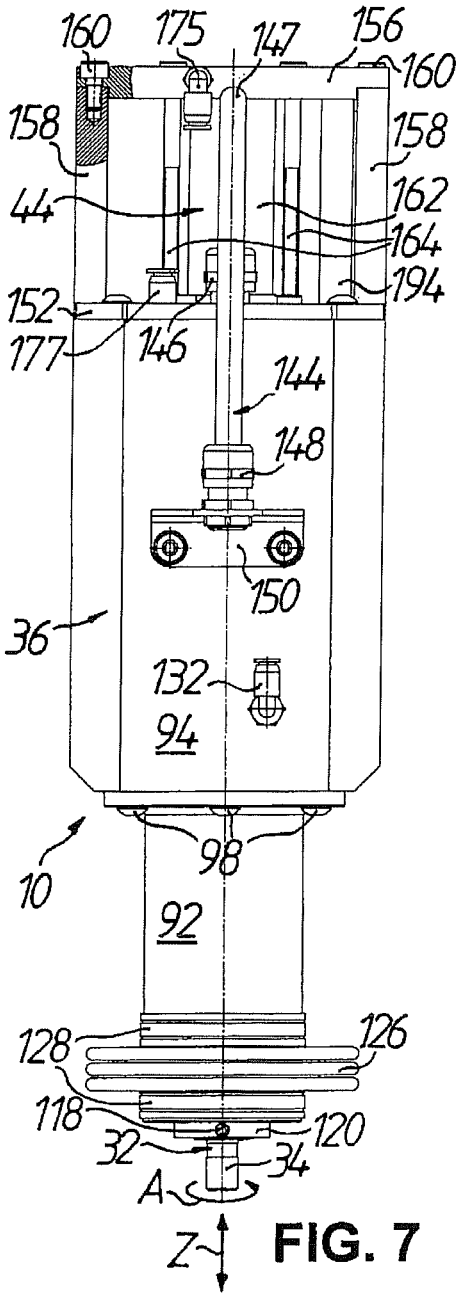
FIG. 7 is a partly broken-away front view of the device of FIG. 6.
Figure 8:
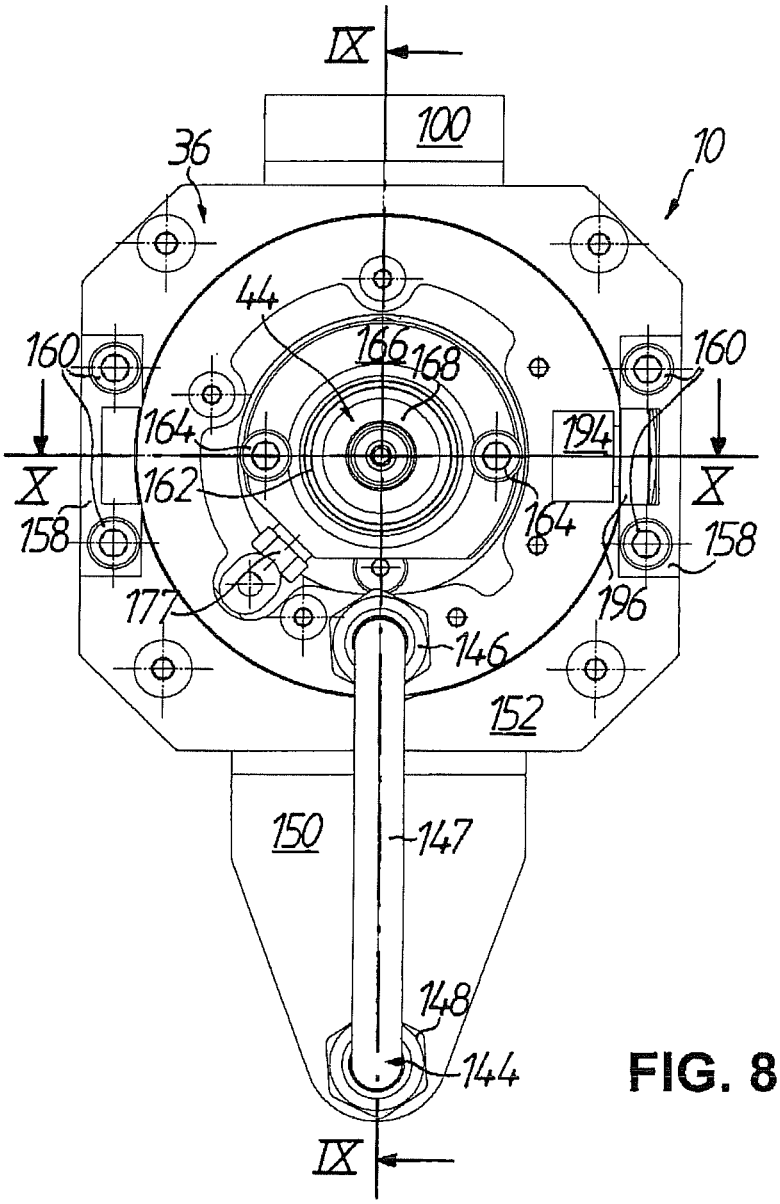
FIG. 8 is a plan view, which is enlarged in scale by comparison with FIGS. 6 and 7, of the device of FIGS. 6 and 7, wherein a plate-shaped cylinder mount, at the top in FIGS. 6 and 7, has been omitted so as to provide a view of the components disposed thereunder.

Suitable seals for sealing relative to the polishing medium are provided in the region of the lower end of the spindle shaft 32 in FIGS. 9 to 11. The seals have a labyrinth seal composed of a bellows ring 116, which is plugged onto the spindle sleeve 102 and clamped by a grub screw 114 (FIG. 9), and of a baffle disc 120, which is plugged onto the spindle shaft 32 and clamped by a further grub screw 118 (FIG. 9) and which rotates with the spindle shaft 32. The two parts 116 and 120 of the labyrinth seal are sealed relative to the spindle shaft 32 and the spindle sleeve 102, respectively, by respective O-rings 122. In addition, a further sealing ring 124, for example an elastomeric V sealing ring, is inserted between the spindle shaft 32 and the bellows ring 116. In order to protect the axial guide (ball bushings 104) from polishing medium a bellows 126 is fastened in a respective annular groove at the lower end of the housing lower part 92 and at the bellows ring 116 by band clamps 128 (FIG. 7).

The rotor 40 and the stator 42 of the electric rotary drive 38 are mounted together in the motor housing 106 to be non-displaceable relative to one another in the direction of the tool rotational axis A. The adjusting device 44 is operatively connected with the motor housing 106, as will be explained in more detail, so that the motor housing 106 together with the spindle sleeve 102 and the spindle shaft 32 mounted therein is axially displaceable relative to the spindle housing 36 in the direction of the tool rotational axis A (linear movement Z).

The stator 42 of the electric rotary drive 38, the windings of which are only schematically shown in FIG. 11, is cast integrally with the motor housing 106 in the interior of the motor housing 106. The electric rotary drive 38 is air-cooled and has for this purpose a fanwheel (not illustrated) in the upper region of the rotor 40. In addition, through the provision of bores 130 (FIG. 9) in the base of the motor housing 106 an air exchange is provided when axial movement (linear movement Z) of the electric rotary drive 38 occurs, for example, for each loading process. When this axial movement occurs, air flows through the electric rotary drive 38 and cools rotor 40 and stator 42. This air exchange can be additionally assisted by compressed air supplied via an auxiliary air connection 132 mounted laterally at the bottom on the housing upper part 94 and leading to the interior space of the spindle housing 36 (FIGS. 6 and 7). If needed, a permanent air cooling of the electric rotary drive 38 can be provided. In order to ascertain such a need, a thermosensor 134 can be provided (FIG. 9).

At its end which is upper in FIGS. 9 to 11 and protrudes into the motor housing 106 the spindle shaft 32 carries the rotor 40 which is connected thereat in suitable manner, for example by a ring clamping element 136 or another known form of shaft/hub connection, with the spindle shaft 32 to be secure against rotation relative thereto. The associated clamping screws 138 in that case serve at the same time for fastening of the fanwheel (not shown). The motor housing 106 is closed towards the top in FIGS. 9 to 11 by an end plate 140 which is fastened by a Seeger circlip ring 142 in an annular groove of the motor housing 106.

According to FIG. 9, energy and thermosensor cables 144 of the electric rotary drive 38, which in fact has a large, steplessly controllable rotational speed range, are led out of the device 10 by way of an opening in the end plate 140 by a cable screw gland 146. In this connection, the energy and thermosensor cables 144 are guided in a U-shaped elbow 147 to a further cable screw gland 148, which in turn is fastened to a fastening bracket 150 screw-connected with the housing part 94. By this simple measure it is ensured that the energy and thermosensor cables 144 during axial movement of the motor housing 106 into the housing upper part 94 of the spindle housing 36 are not exposed to an excessive kinking or bending load and thus cannot break. A fastening flange 152, which closes off the housing upper part 94 at the top in FIGS. 9 to 11 and which is screw-connected therewith (not shown in more detail), forms an abutment, which is at the top in these figures, for the motor housing 106.

The axial adjusting device 44 is a piston-cylinder arrangement which can be pneumatically acted on at two sides and which comprises a piston rod 154, by way of which the axial displacing movement (linear movement Z) is transmissible to the electric rotary drive 38 and which is axially aligned with the spindle shaft 32. Provided for fastening of the axial adjusting device 44 to the spindle housing 36 is a bridge-like mounting structure which is made from an upper, plate-shaped cylinder mount 156 and two plate-shaped guide parts 158 arranged on both sides thereof. The guide parts 158 are mounted on the fastening flange 152 by countersunk-head screws (not shown). The cylinder mount 156 is screw-connected with the guide parts 158 by cap screws 160 (see FIG. 7).

The axial adjusting device 44 further includes a cylinder tube 162 which is fastened to the cylinder mount 156 with the help of two long cap screws 164 and a cylinder cover 166 and, in particular, by clamping in place between cylinder mount 156 and cylinder cover 166. A piston 168, at which the piston rod 154 is mounted, is received in the cylinder tube 162 to be longitudinally displaceable, the piston rod being led through the cylinder cover 166 in sealed manner by a sealing wiper ring 170 provided in the cylinder cover 166. The sealing of the cylinder tube 162 is by O-rings 172 which are retained in each of the cylinder mount 156 and the cylinder cover 166 in an annular groove. In the cylinder tube 162 the piston 168 separates a pressure chamber 174, which is at the cylinder mount side and which can be loaded with pressure by way of a transverse bore (not shown; extending from the pressure connection 175 in FIGS. 6, 7 and 9) in the cylinder mount 156 in order to move out the tool mount section 34 of the spindle shaft 32, from a pressure chamber 176, which is at the cylinder cover side and which can be loaded with pressure by way of a transverse bore (not illustrated; extending from the pressure connection 177 in FIGS. 6 to 11) provided in the cylinder cover 166, in order to retract the tool mount section 34.

According to FIGS. 9 to 11 the piston rod 154 of the axial adjusting device 44 is operatively connected with the electric rotary drive 38 by way of a diaphragm cylinder 180, which comprises a diaphragm 178, for transmission of the axial displacing movement (linear movement Z). For this purpose the end plate 140 of the electric rotary drive 38 is provided at its side, which is upper in FIGS. 9 to 11, with a circularly round, trough-shaped depression which forms a pressure chamber 182—which is lower in these figures—of the diaphragm cylinder 180. Also provided is a diaphragm cover 184, which is similarly provided with a depression and which is screw-connected with the end plate 140 and in that case clamps the diaphragm 178 in place with formation of a chamber 186 at the top in FIGS. 9 to 11 (see FIG. 11), so that the pressure chamber 182 is hermetically and pressure-tightly sealed off relative to the environment. More specifically, the diaphragm 178, which is made from an elastomeric material, is of annular disc-shaped form. In that case it is mounted at its inner circumference on the piston rod 154 of the adjusting device 44 by an annular bead 188 (see FIG. 11), which is clamped in place in mechanically positive manner (by annular grooves at the washers) between two washers by way of a hollow-drilled screw screwed into the piston rod 154. At its outer circumference, the diaphragm 178 is clamped in place in mechanically positive manner, by an annular bead 190 (see again FIG. 11) engaged in annular grooves in the end plate 140 and diaphragm cover 184, between the diaphragm cover 184 and the end plate 140 of the electric rotary drive 38, so that the force flow of an axial force applied to the piston rod 154 runs from the piston rod 154 to the electric rotary drive 38 by way of the diaphragm 178.

As can be further inferred from FIGS. 9 to 11, the piston rod 154 of the axial adjusting drive 44 has a passage bore 192 which pneumatically connects the pressure chamber 174, which is remote from the tool mount section 34 of the spindle shaft 32, of the adjusting device 44 with the pressure chamber 182, which faces the tool mount section 34, of the diaphragm cylinder 180. Since the mutually facing pneumatically effective surfaces in the pressure chambers 174, 182 are of substantially the same size, the forces acting on the diaphragm 178 cancel one another when the pressure chamber 174 of the adjusting device 44 is loaded with pressure.

Moreover, the motor housing 106 of the electric rotary drive 38 is secured against rotation relative to the spindle housing 36 by a torque support 194, one end of which is fastened to the motor housing 106, and its other end carries a rotatably mounted guide roller 196 bearing against a guide surface 198 at the spindle housing side. According to FIG. 10, in this connection the substantially block-shaped torque support 194 is screw-connected with an annular cover disc 200, which in turn is screw-connected with the end plate 140, as can be seen from FIG. 9, wherein end plate 140 and cover disc 200 clamp the circlip ring 142 therebetween. Accordingly, the torque support 194 and the spindle sleeve 102 axially guided in the housing lower part 92 of the spindle housing 36 are arranged on sides which are axially opposite with respect to the motor housing 106. The guide surface 198 at the spindle housing side is, in fact, formed by a longitudinal groove in the corresponding guide part 158, which quasi represents a gate guide for the guide roller 196.

Finally, the polishing tool 46 retained at the tool mount section 34 of the spindle shaft 32 by a grub screw is illustrated by way of example in FIG. 11. This tool can basically correspond with the polishing tools disclosed in the specifications U.S. Pat. No. 7,066,794 B2, U.S. Pat. No. 7,278,908 B2 and U.S. Patent Application Publication 2008/0305723 A1 already mentioned in the introduction. In the present case, however, the cavity in the polishing tool 46 is not actively loaded with pressure, but is filled with, for example, a fluid (gas or silicon oil). A polishing plate 204 is exchangeably mounted on the polishing tool 46 by way of an interface 202. Such polishing plates 204 are evident from, for example, the specification U.S. Patent Application Publication 2008/0305723 A1 of the present applicant; the interface 202 substantially corresponds with the interface illustrated and described in German patent application DE 10 2009 036 981.3 of the present applicant. To that extent, incorporation by the above mentioned reference to the specifications is made herein. Moreover, for the sake of simplicity in FIG. 11 the motor housing 106 of the electric rotary drive 38 is shown abutting the base of the housing upper part 94 of the spindle housing 36. Such a relative position of these parts is not, however, achieved in reality. Rather, even during the polishing process the motor housing 106 is always at least slightly spaced from the base of the housing part 94. FIG. 11 also shows the lens L, which has a first optically effective surface cx at one side and a second optically effective surface cc at an opposite side, mounted on the spindle 20 (shown in dashed lines) by way of a block member S with interposed block material M holding the lens L.

A device for finish-machining of optically effective surfaces of, in particular, spectacle lenses is disclosed. The device has a spindle shaft with a tool mount section and which is mounted in a spindle housing to be rotatable about a tool rotational axis, an electric rotary drive, which comprises a rotor and a stator and by which the spindle shaft operatively connected with the rotor is drivable to rotate about the tool rotational axis, and an adjusting device, by which the tool mount section is axially displaceable with respect to the spindle housing in the direction of the tool rotational axis. Features of the device are that the rotor and the stator are arranged coaxially with the spindle shaft and that by the adjusting device at least the rotor together with the spindle shaft are axially displaceable with respect to the spindle housing in the direction of the tool rotational axis. This allows, in particular, a very compact construction.

Variations and modifications are possible without departing from the scope and spirit of the present invention as defined by the appended claims.

We claim:

1. A device for the finish-machining of optical surfaces of optical workpieces, comprising:

a spindle housing;

a spindle shaft having a tool mount section and defining an axis of rotation for a tool to be carried by the tool mount section, the spindle shaft being mounted in the spindle housing to be rotatable about the tool axis of rotation;

an electric rotary drive for driving the spindle shaft to rotate about the tool axis of rotation, the electric rotary drive comprising a rotor, which is operatively connected with the spindle shaft, and a stator, and the rotor, stator and spindle shaft being coaxial; and an adjusting device that is constructed for axially displacing at least the rotor of the electric rotary device and the spindle shaft inclusive of the tool mount section relative to the spindle housing in the direction of the tool axis of rotation.

2. A device according to claim 1, wherein the electric rotary drive comprises a motor housing accommodating both the rotor and the stator, the rotor and the stator being mounted in the housing to be non-displaceable relative to one another in the direction of the tool axis of rotation and the adjusting device being operatively connected with the motor housing and operable to displace the motor housing together with the spindle shaft relative to the spindle housing in the direction of the tool axis of rotation.

3. A device according to claim 1, wherein the adjusting device comprises a double-acting pneumatic piston-cylinder unit comprising a piston rod for transmitting axial displacement to at least the rotor of the electric rotary drive and the spindle shaft in the direction of tool axis of rotation, the piston-cylinder unit being disposed in axial alignment with the spindle shaft.

4. A device according to claim 3, comprising a diaphragm cylinder for transmitting said axial displacement, the diaphragm cylinder operatively connecting the piston rod with the electric rotary drive and comprising a diaphragm.

5. A device according to claim 4, wherein the diaphragm is substantially annular with an inner circumference and an outer circumference and is fixed at its inner circumference to the piston rod and at its outer circumference to the electric rotary drive whereby axial force is transmissible from the piston rod to the electric rotary drive by way of the diaphragm.

6. A device according to claim 4, wherein the diaphragm comprises elastomeric material.

7. A device according to claim 4, wherein the adjusting device defines a first pneumatic pressure chamber remote from the tool mount section of the spindle shaft and the diaphragm cylinder defines a second pneumatic pressure chamber between the first pressure chamber and the tool mount section, and wherein the piston rod defines a passage bore pneumatically interconnecting the first and second pressure chambers, the first and second pressure chambers having mutually facing pneumatically effective surfaces of substantially the same size.

8. A device according to claim 1, comprising a spindle sleeve axially guided at an outer circumference thereof with respect to the spindle housing, the spindle shaft being rotatably mounted in the spindle sleeve.

9. A device according to claim 8, comprising at least one ball bushing guiding the spindle sleeve with respect to the spindle housing.

10. A device according to claim 8, wherein the electric rotary drive comprises a motor housing and the spindle sleeve is mounted on the motor housing.

11. A device according to claim 10, wherein the spindle housing comprises a first housing part adjacent to the tool mount section of the spindle shaft and having a first internal housing diameter, and a second housing part remote from the tool mount section of the spindle shaft and having a second internal housing diameter larger than the first internal housing diameter, the spindle sleeve being guided in the first housing part to be axially displaceable therein and the motor housing being guided in the second housing part to be axially displaceable therein, the housing having a radial play relative to the spindle housing.

12. A device according to claim 11, comprising a torque support for resisting rotation of the motor housing relative to the spindle housing, the torque support being fixed at one end to the motor housing and provided at the one end with a rotatable guide roller, and the spindle housing defining a guide surface guiding the guide roller.

13. A device according to claim 12, wherein the torque support and the spindle sleeve are disposed on axially opposite sides of the motor housing.

14. A polishing machine for simultaneous polishing of two workpieces in the form of spectacle lenses, comprising:

a machine housing bounding a working space;

two rotatable workpiece spindles each protruding into the working space and each for carrying a respective workpiece to be polished in the working space, the workpiece spindles defining mutually parallel axes of rotation for the workpieces;

a common rotary drive for rotating the workpiece spindles about the workpiece axes of rotation;

a tool carriage defining a linear axis extending substantially perpendicularly to the workpiece axes of rotation;

a linear drive unit for moving the tool carriage along the linear axis;

a pivot yoke carried by the carriage and defining a pivot axis extending substantially perpendicular to the workpiece axes of rotation and to the linear axis;

a pivot drive unit for pivoting the pivot yoke about the pivot axis, the pivot drive unit being mounted on the carriage; and two devices according to claim 1 each protruding into the working space and each having the tool mount section of the spindle shaft thereof disposed in association with a respective one of the workpiece spindles, each device being mounted by the spindle housing thereof on the pivot yoke in a position whereby the tool axis of rotation of the spindle shaft of the device forms together with the workpiece axis of rotation of the associated workpiece spindle of the machine a plane in which said tool axis of rotation is axially displaceable and tiltable relative to said workpiece axis of rotation.

* * * * *